US010084243B2

(12) United States Patent
Cohen et al.

(10) Patent No.: US 10,084,243 B2
(45) Date of Patent: Sep. 25, 2018

(54) ANTENNA ISOLATOR

(71) Applicant: Galtronics Corporation Ltd., Tempe, AZ (US)

(72) Inventors: Chen Cohen, Upper Tiberias (IL); Haim Yona, Upper Tiberias (IL)

(73) Assignee: GALTRONICS CORPORATION LTD., Tempe, AZ (US)

( * ) Notice: Subject to any disclaimer, the term of this patent is extended or adjusted under 35 U.S.C. 154(b) by 168 days.

(21) Appl. No.: 14/947,150

(22) Filed: Nov. 20, 2015

(65) Prior Publication Data

US 2016/0156110 A1 Jun. 2, 2016

Related U.S. Application Data

(60) Provisional application No. 62/085,470, filed on Nov. 28, 2014.

(51) Int. Cl.

| | |
|---|---|
| ***H01Q 21/30*** | (2006.01) |
| ***H01Q 21/28*** | (2006.01) |
| ***H01Q 1/52*** | (2006.01) |
| ***H01Q 9/28*** | (2006.01) |
| ***H01Q 21/20*** | (2006.01) |
| ***H01Q 21/24*** | (2006.01) |
| ***H01Q 17/00*** | (2006.01) |

(52) U.S. Cl.

CPC ..... *H01Q 21/28* (2013.01); *H01Q 1/523* (2013.01); *H01Q 9/285* (2013.01); *H01Q 17/00* (2013.01); *H01Q 21/205* (2013.01); *H01Q 21/24* (2013.01); *H01Q 21/30* (2013.01)

(58) Field of Classification Search

CPC ..... H01Q 5/48; H01Q 9/16; H01Q 9/265; H01Q 9/285; H01Q 9/44; H01Q 19/108; H01Q 21/062; H01Q 21/30; H01Q 21/28; H01Q 21/24

USPC ..... 343/810, 893

See application file for complete search history.

(56) References Cited

U.S. PATENT DOCUMENTS 6,201,510 B1 * 3/2001 Lopez ..... H01Q 9/16 343/797
6,310,584 B1 * 10/2001 Reece ..... H01Q 9/285 343/725

(Continued)

FOREIGN PATENT DOCUMENTS

| | | |
|---|---|---|
| JP | 2002026629 A | 1/2002 |
| WO | 2014064516 A1 | 5/2014 |

OTHER PUBLICATIONS

European Patent Office International Searching Authority, International Search Report and Written Opinion for International Application No. PCT/IB2015/059095 dated Feb. 11, 2016.

(Continued)

*Primary Examiner* — Hoang Nguyen
*Assistant Examiner* — Awat Salih
(74) *Attorney, Agent, or Firm* — LKGlobal | Lorenz & Kopf, LLP

(57) ABSTRACT

An antenna, including, but not limited to, a multiple input multiple output antenna is provided. The antenna may include, but is not limited to, a transmission array configured to radiate in a first frequency range, the transmission array including a plurality of dipoles, and an isolator located between the plurality of dipoles of the transmission array, the isolator including at least one conductive strip.

17 Claims, 2 Drawing Sheets

(56) References Cited

U.S. PATENT DOCUMENTS

| | | | | |
|---|---|---|---|---|
| 6,545,646 | B2 * | 4/2003 | Marchand | H01Q 1/248 343/745 |
| 2007/0152903 | A1 | 7/2007 | Lin et al. | |
| 2009/0066601 | A1 * | 3/2009 | Eom | H01Q 1/2291 343/798 |
| 2009/0207092 | A1 * | 8/2009 | Nysen | H01Q 1/2275 343/876 |
| 2010/0053010 | A1 * | 3/2010 | Shtrom | H01Q 9/285 343/749 |
| 2010/0207811 | A1 * | 8/2010 | Lackey | G01S 19/21 342/357.44 |
| 2012/0038533 | A1 * | 2/2012 | Jung | H01Q 9/285 343/810 |
| 2013/0321240 | A1 * | 12/2013 | O'Shea | H01Q 9/285 343/893 |
| 2014/0313094 | A1 * | 10/2014 | Berezin | H01Q 1/521 343/810 |
| 2015/0244070 | A1 * | 8/2015 | Cheng | H01Q 3/24 343/836 |
| 2016/0294063 | A1 * | 10/2016 | McGough | H01Q 9/28 |

OTHER PUBLICATIONS

The International Bureau of WIPO, International Preliminary Report on Patentability for International Application No. PCT/IB2015/059095 dated Jun. 8, 2017.

* cited by examiner

ANTENNA ISOLATOR

CROSS-REFERENCE TO RELATED APPLICATION(S)

This application claims the benefit of U.S. provisional patent application Ser. No. 62/085,470, filed Nov. 28, 2014, the entire content of which is incorporated by reference herein.

TECHNICAL FIELD

The present disclosure generally relates to antennas, and more particularly relates to isolators for improving a performance of an antenna.

BACKGROUND

Modern antennas often include multiple transmission elements operating around the same frequency range. The multiple transmission elements increase the capacity of the antenna and are essential for the operation of a wide variety of wireless applications including, but not limited to, wireless communication standards including IEEE 802.11n (Wi-Fi), IEEE 802.11ac (Wi-Fi), HSPA+ (3G), WiMAX, and Long Term Evolution.

BRIEF SUMMARY

In accordance with an embodiment, a multiple input multiple output antenna is provided. The multiple input multiple output antenna may include, but is not limited to a transmission array configured to radiate in a first frequency range, the transmission array including a plurality of dipoles, and an isolator located between the plurality of dipoles of the transmission array, the isolator including at least one conductive strip.

In accordance with another embodiment, for example, an antenna is provided. The antenna may include, but is not limited to, a first transmission array configured to radiate in a first frequency range, the first transmission array including a plurality of dipoles, a second transmission array configured to radiate in a second frequency range different than the first transmission range, the second transmission array including a plurality of dipoles, and an isolator located between the plurality of dipoles of the second transmission array, the isolator including at least one conductive strip.

BRIEF DESCRIPTION OF THE DRAWINGS

The detailed description will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or detail of the following detailed description.

As discussed above, antenna often include multiple transmission elements operating around the same frequency range. By including multiple transmission elements within the same antenna, the data transmission capacity of the antenna can be increased. The directivity of the antenna can also be increased by having multiple transmission elements. However, because the multiple transmission elements are so close together and operate around the same frequency range, the transmission elements can interfere with each other. Accordingly, as discussed in further detail below, an antenna isolator is provided to reduce interference between the transmission elements of the antenna.

Figure 1:
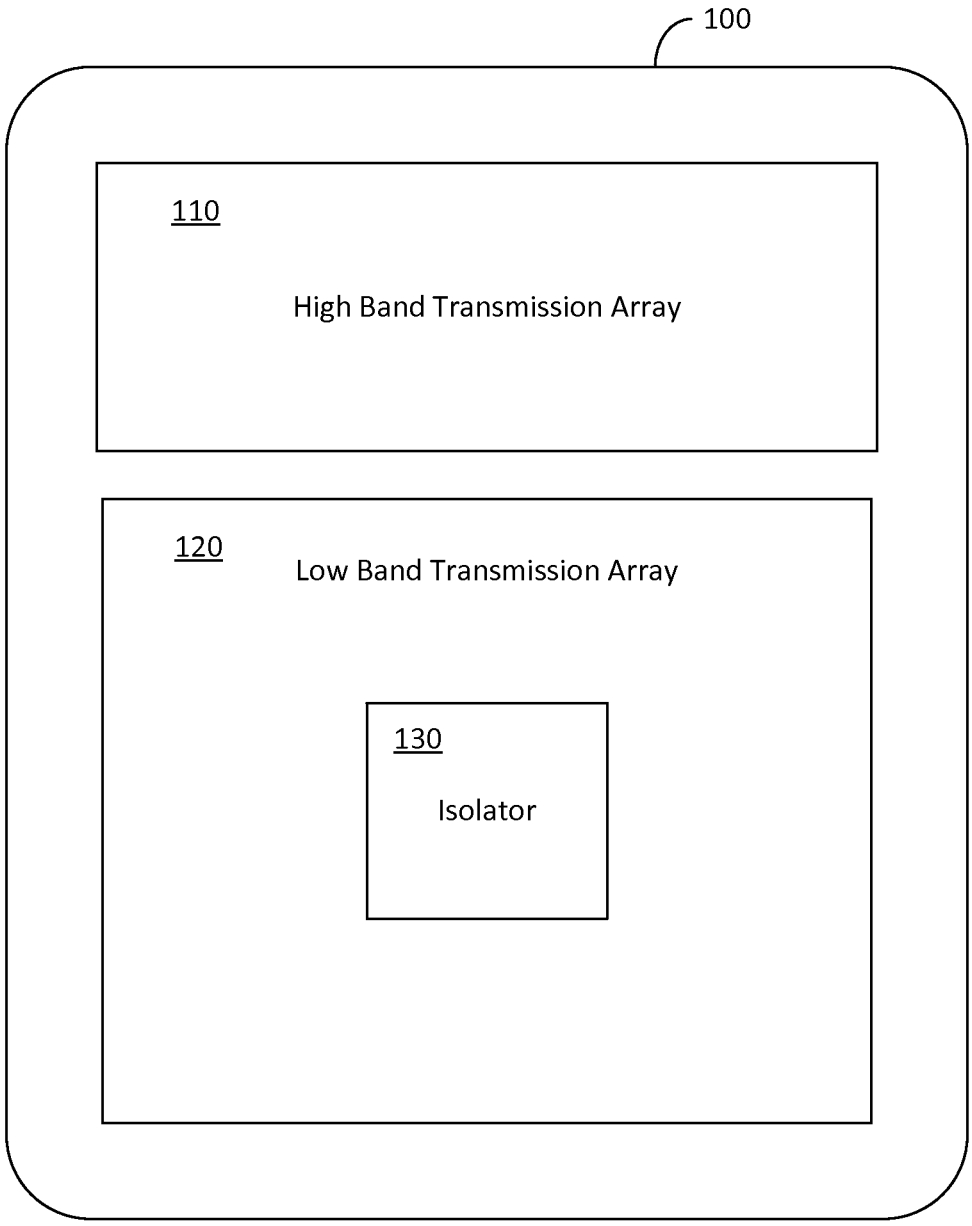
FIG. 1 is a block diagram of a multiple input, multiple output (MIMO) antenna, in accordance with an embodiment.

FIG. 1 is a block diagram of a multiple input, multiple output (MIMO) antenna 100, in accordance with an embodiment. The MIMO antenna 100 could be used, for example, in a Wi-Fi communication system, a HSPA+ communication system, a WiMAX communication system, a long term evolution (LTE) communication system, or the like.

In one embodiment, for example, the MIMO antenna 100 includes a high band transmission array 110 and a low band transmission array 120. Each transmission array may have multiple transmission elements, such as dipoles. However, in various other embodiments the MIMO antenna 100 may only include the low band transmission array 120 when, for example, the system utilizing the MIMO antenna 100 only operates within a lower frequency range.

In one embodiment, for example, the high band transmission array 110 may operate over a frequency range of, for example, 1.695 gigahertz (GHz) through 2.7 GHz. However, the frequency range of the high band transmission array 110 could vary depending upon the desired operating range of the MIMO antenna.

The high band transmission array 110 may include multiple high band dipoles. In one embodiment, for example, the plurality of high band dipoles may be arranged approximately 90 degrees to each other to provide plus and minus 45 degree polarization. However, in other embodiments, the dipoles of the high band transmission array 110 may be arranged to have vertical polarization or horizontal polarization.

The low band transmission array 120 may operate over a frequency range of, for example, 695 megahertz (MHz) through 960 MHz. However, the frequency range of the low band transmission array 120 could vary depending upon the desired operating range of the MIMO antenna 100. By utilizing both a high band transmission array 110 and a low band transmission array 120, the MIMO antenna 100 can operate over a wider frequency range.

The low band transmission array 120 may include one or more sets of low band dipoles. In one embodiment, for example, each set of the low band transmission array 120 may have four low band dipoles, with two dipoles operating in a first polarization plane and two dipoles operating in a second polarization plane. Accordingly, the MIMO antenna 100 may also be considered to include double arrayes, each array including more than one dipole operating in a polarization plane. In one embodiment, for example, the low band dipoles may be arranged approximately 90 degree to each other to provide plus and minus 45 degree polarization.

However, in other embodiments, the low band transmission array 120 may be arranged to have vertical polarization or horizontal polarization.

Because the low band transmission array 120 utilizes multiple dipoles, interference between the dipoles can occur. The interference can affect the performance of the MIMO antenna 100 by causing data corruption. Accordingly, the MIMO antenna 100 further includes an isolator 130 to reduce the interference between the dipoles of the low band transmission array 120. As discussed in further detail below, the isolator 130 is arranged between the dipoles of the low band transmission array 120 and includes at least one conductive strip to improve the isolation between the multiple dipoles of the low band transmission array 120.

Figure 2:
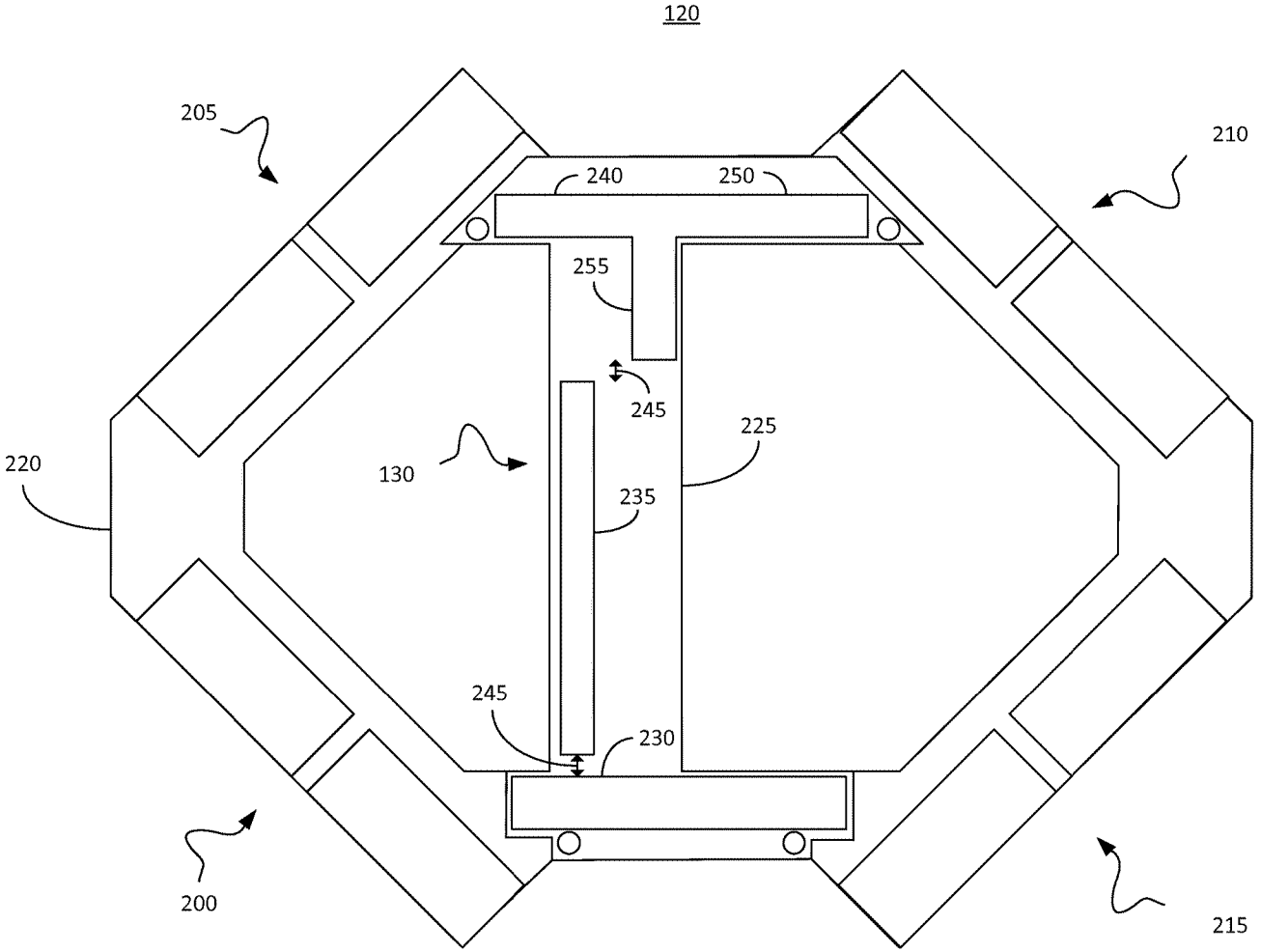
FIG. 2 illustrates an exemplary low band transmission array, in accordance with an embodiment.

FIG. 2 illustrates an exemplary low band transmission array 120, in accordance with an embodiment. In the embodiment illustrated in FIG. 2, the low band transmission array 120 includes four dipoles 200, 205, 210 and 215. As seen in FIG. 2, the dipoles 200-215 are arranged approximately 90 degrees to each other to provide plus and minus 45 degree polarization. In this embodiment, dipoles 200 and 210 operate in a minus 45 degree plane and dipoles 205 and 215 operate in a plus 45 degree plane. However, as discussed above, the dipoles 200-215 could also be arranged to have vertical polarization or horizontal polarization.

In the embodiment illustrated in FIG. 2, the dipoles 200-215 each comprise a conductive element defined on a single printed circuit board 220. However, in other embodiments, each dipole 200-215 could be formed on its own printed circuit board.

As discussed above, the MIMO antenna 100 further includes an isolator 130 to improve the performance of the low band transmission array 120 by reducing the interference between the dipoles 200-215 of the low band transmission array 120. As seen in FIG. 2, the isolator 130 is arranged between the dipoles 200-215. In this embodiment, the dipoles 200-215 as well as the isolator 130 may be formed on the same printed circuit board. However, in other embodiments, the isolator 130 may be formed on a separate printed circuit board, or may be formed on a printed circuit board with one or more, but not all, of the dipoles 200-215. The isolator 130 may be arranged to be in the same plane as the dipoles 200-215 or may be arranged in another plane. In other words, the isolator 130 could be arranged in a plane parallel to a plane of the dipoles 200-215, but at either a higher or lower elevation relative to back of the MIMO antenna 100. In other embodiments, for example, the isolator 130 may be mounted at an angle relative to the dipoles 200-15. By adjusting the angle and elevation of the isolator 130, the performance of the isolator 130 can be tuned to the specific frequency range where the antenna is suffering from interference.

The isolator 130 includes a non-conductive plate 225. The non-conductive plate 225 galvanically isolates the dipoles 200-215 from the dipoles 200-215. In the embodiment illustrated in FIG. 2, the non-conductive plate is formed on the same printed circuit board as the dipoles 200-215. However in other embodiments, for example, the non-conductive plate 225 may be formed on a different printed circuit board, 3D printed, or the like.

The isolator 130 illustrated in FIG. 2 further includes three conductive strips 230, 235 and 240 formed on the non-conductive plate 225. The conductive strips 230-240 improve the isolation between the two polarized plane waves in which the low band transmission array 120 radiates by absorbing, reflecting and deflecting radio waves within the center of the dipoles 200-215. As discussed above, the dipoles 200-215 illustrated in FIG. 2 are arranged to radiate in a plus and minus 45 degree plane. However, the dipoles of an MIMO antenna could also be arranged for vertical polarization or horizontal polarization. In these embodiments, the conductive strips of the isolator would have to be rotated 45 degrees to account for the change in polarization.

The non-conductive plate 225 galvanically isolates the conductive strips 230-240 from the dipoles 200-215. In one embodiment, for example, the conductive strips 230-240 may be formed by copper deposited on the non-conductive plate 225 of the isolator 130. However, in other embodiments, the conductive strips 230-240 may be formed by any metal sheet or other conductive material. While the conductive strips 230-240 are illustrated as being in the same plane relative to each other, in other embodiments, the isolator 130 may be formed with conductive strips at varying elevations and angles. By adjusting the angle and elevation of the conductive strips, the performance of the isolator 130 can be tuned to the specific frequency range where the antenna is suffering from interference.

The conductive strips 230-240 are preferably non-overlapping in at least one direction. As seen in FIG. 2, each of the conductive strips 230-240 are non-overlapping in the vertical direction indicated by arrows 245. In other words, there is vertical separation between each of the conductive strips 230-240. This prevents the conductive strips 230-240 from interacting with each other. However, in other embodiments, the conductive strips may be arranged to be non-overlapping in the horizontal direction (perpendicular to arrows 245) or both in the horizontal and vertical directions.

Furthermore, as seen in FIG. 2, all of the conductive strips 230-240 are encompassed by the dipoles 200-215 of the low band transmission array 120, limiting the effect the conductive strips 230-240 have on the radiation pattern of the low band transmission array 120. In other words, the conductive strips 230-240 do not extend beyond a perimeter defined in part by the edge of the dipoles 200-215.

Each conductive strip 230-240 is defined by a length and a width. The length and width control a range of frequencies which each of the conductive strips 230-240 absorb, reflect and deflect. In one embodiment, for example, each conductive strip 230-240 has a length of approximately ($\lambda/4$), where $\lambda$ is a wavelength each conductive strip 230-240 is configured to absorb, reflect and deflect and absorbs, reflects and deflects a range of frequencies centered around the selected wavelength. As seen in FIG. 2, strips 230 and 235 are substantially rectangular in shape. In this embodiment, the length and width of strip 230 is defined to absorb frequencies in the range of 700-750 MHz and the length and width of strip 235 is defined to absorb frequencies in the range of 700-750 MHZ. However, the position of the conductive strips within the bounds of the dipoles 200-215 can also affect the frequency range. As seen in FIG. 2, the length of conductive strip 230 is less than a length of conductive strip 235 even though both are designed absorb, reflect and deflect frequencies in the same frequency range in this illustrative embodiments.

As discussed above, the conductive strips 230-240 are non-overlapping in at least one direction and are fully encompassed within the bounds of the dipoles 200-215 of the low band transmission array 120. Accordingly, the number of conductive strips and the length thereof are limited by the size and spread of the dipoles 200-215. As seen in FIG. 2, strip 240 is substantially T shaped. The T-shape allows for the conductive strip 240 to absorb multiple frequency ranges while minimizing the space taken within the bounds of the dipoles 200-215. In this embodiment, the horizontal portion 250 of the conductive strip 240 absorbs frequencies in the range of 700-750 MHz, while the vertical portion 255 the conductive strip 240 absorbs frequencies in the range of 870-960 MHz. However, the operating range of the T-shape conductive strip 240 can be altered by modifying the length and width of each of the vertical and horizontal portions of the T-shape conductive strip. In other embodiments, the conductive strip may be I-shaped, L-shaped, F-shaped, E-shaped, or the like, with each arm of the respective shape configured to absorb, reflect, and deflect a range frequencies depending upon the respective length of each arm of the respective shape and the position of the strip relative to one or more dipoles of the antenna.

While the conductive strips 230-240 minimally affect the radiation pattern of the MIMO antenna 100, the conductive strips 230-240 can be used to influence the radiation patterns created by low band transmission array 120 to improve the radiation patterns. For example, as seen in FIG. 2, the conductive strip 235 and the vertical portion 255 of the conductive strip 240 are off-center relative a plane defined in the middle of the low band transmission array 120. By positioning a conductive strip off-center, the radiation pattern of the low band transmission array 120 can be tuned for increase performance. Additionally, conductive strips 230-240 may serve to absorb stray radiation from the surroundings of the MIMO antenna 100, thereby further improving the performance of MIMO antenna 100.

In addition to improved isolation and performance, the inclusion of isolator 130 in the MIMO antenna 100 may decrease manufacturing costs, improve the reliability of the MIMO antenna 100, and increase a robustness of the MIMO antenna 100. For example, a consistent relative placement both between conductive strips 230-240 themselves and between the conductive strips 230-240 and the dipoles 200-215 of the low band transmission array 120 improves a consistency between MIMO antennas 100. By defining conductive strips 230-240 on a printed circuit board, their locations with respect to each other may be fixed. Likewise, by fixing the non-conductive plate 225 with respect to the dipoles 200-215 of the low band transmission array 120, the relative positioning of conductive strips 230-240 with respect to the dipoles 200-215 of the low band transmission array 120 may be easily achieved and maintained. Such fixation may decrease manufacturing costs because the antennas don't require individual positioning. Such fixation may also increase the reliability of the MIMO antenna 100 because positioning conductive strips 230-240 on a printed circuit board may ensure that the conductive strips 230-240 are properly located with respect to each other. Finally, such fixation may improve a robustness of the MIMO antenna 100, as the positioning of conductive strips 230-240 on a fixed printed circuit board may prevent them from shifting when the MIMO antenna 100 is subjected to environmental shocks such as winds, rain, snow, earthquakes or the like.

In other embodiments, the isolator 130 and the dipoles may be manufactured using alternative techniques such as laser direct structuring, 3-D printing, injection molding, or the like. These embodiments may also allow for a consistent relative placement both between conductive strips 230-240 themselves and between the conductive strips 230-240 and the dipoles 200-215 of the low band transmission array 120.

While FIG. 2 is illustrated to include three conductive strips 230-240, the exact shape, size, and quantity of conductive strips may be varied to improve the performance of the MIMO antenna 100, depending on other features of MIMO antenna 100. For example, if the MIMO antenna 100 were configured to be larger or smaller, to radiate in different frequency ranges, or if the relationship between low band transmission array 120 were altered, the size, shape, and quantity of the conductive strips may be altered accordingly.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A multiple input multiple output antenna, comprising:

a transmission array configured to radiate in a first frequency range, the transmission array including four dipoles arranged substantially ninety degrees to each other in a substantially diamond configuration and having a plus and minus forty-five degree polarization; and an isolator located in the middle of all four dipoles of the transmission array, the isolator galvanically isolated from the transmission array, the isolator comprising a plurality of conductive strips, each of the plurality of conductive strips being non-overlapping with every other of the plurality of conductive strips in at least one direction, each of the plurality of conductive strips having an electrical length of one quarter of a wavelength that each of the plurality of conductive strip is arrange to absorb, at least one of the plurality of conductive strips configured to absorb at least two separate frequency ranges.

2. The multiple input multiple output antenna of claim 1, wherein the isolator comprises a non-conductive plate galvanically isolating the plurality of conductive strips from the four dipoles.

3. The multiple input multiple output antenna of claim 2, wherein the non-conductive plate and the plurality of conductive strips of the isolator are formed on a printed circuit board.

4. The multiple input multiple output antenna of claim 3, wherein the non-conductive plate, the plurality of conductive strips and the dipoles are formed on the printed circuit board.

5. The multiple input multiple output antenna of claim 1, wherein at least one of the plurality of conductive strips is rectangular.

6. The multiple input multiple output antenna of claim 1, wherein at least one of the plurality of conductive strips is T-shaped.

7. The multiple input multiple output antenna of claim 1, wherein the plurality of conductive strip are encompassed with a bounds defined by the four dipoles.

8. The multiple input multiple output antenna of claim 1, wherein the plurality of conductive strips and the plurality of dipoles are arranged in a single plane.

9. An antenna, comprising:

a first transmission array configured to radiate in a first frequency range, the first transmission array including a first plurality of dipoles;

a second transmission array configured to radiate in a second frequency range different than the first frequency range, the second transmission array including four dipoles arranged substantially ninety degrees to each other in a substantially diamond configuration and having a plus and minus forty-five degree polarization; and an isolator located in the middle of the four dipoles of the second transmission array, the isolator comprising a plurality of conductive strips, each of the plurality of conductive strips being non-overlapping with every other of the plurality of conductive strips in at least one direction, each of the plurality of conductive strips having an electrical length of one quarter of a wavelength that each of the plurality of conductive strip is arrange to absorb, at least one of the plurality of conductive strips configured to absorb at least two separate frequency ranges.

10. The antenna of claim 9, wherein the isolator comprises a non-conductive plate galvanically isolating the plurality of conductive strips from the four dipoles of the second transmission array.

11. The antenna of claim 10, wherein the non-conductive plate and the plurality of conductive strips of the isolator are formed on a printed circuit board.

12. The antenna of claim 11, wherein the non-conductive plate, the plurality of conductive strips and at least one of the four dipoles of the second transmission array are formed on the printed circuit board.

13. The antenna of claim 9, wherein at least one of the plurality of conductive strips is rectangular.

14. The antenna of claim 9, wherein at least one of the plurality of conductive strips is T-shaped.

15. The antenna of claim 9, wherein the plurality of conductive strips are encompassed with a bounds defined by the plurality of dipoles.

16. The antenna of claim 9, wherein the plurality of conductive strips and at least the plurality of dipoles of one of the frequency ranges are arranged in a single plane.

17. A multiple-input multiple output antenna, comprising:

a printed circuit board;

a first transmission array, the first transmission array configured to radiate in a first frequency range, the first transmission array including a first plurality of dipoles;

a second transmission array defined on the printed circuit board, the second transmission array configured to radiate in a second frequency range different than the first frequency range, the second transmission array including four dipoles arranged substantially ninety degrees to each other in a substantially diamond configuration and having a plus and minus forty-five degree polarization; and an isolator defined on the printed circuit board, the isolator located in the middle of the four dipoles of the second transmission array, the isolator comprising:

a plurality of conductive strips, the plurality of conductive strips being non-overlapping with every other of the plurality of conductive strips in at least one direction, each of the plurality of conductive strips having an electrical length of one quarter of a wavelength that each of the plurality of conductive strip is arrange to absorb, at least one of the plurality of conductive strips configured to absorb at least two separate frequency ranges; and a non-conductive plate galvanically isolating the plurality of conductive strip from the four dipoles of the second transmission array.

* * * * *